US005209176A

United States Patent [19]

Pompei et al.

[11] Patent Number: 5,209,176

[45] Date of Patent: May 11, 1993

[54] BOAT BOTTOM FLOTATION SCRUBBER

[76] Inventors: Walter Pompei; Nino S. Pompei, both of 2430 Camino Tassajara, Danville, Calif. 94526

[21] Appl. No.: 737,273

[22] Filed: Jul. 29, 1991

Related U.S. Application Data

[63] Continuation-in-part of Ser. No. 568,401, Aug. 16, 1990, Pat. No. 5,105,752.

[51] Int. Cl.[5] ..... B63B 55/08

[52] U.S. Cl. ..... 114/222; 15/144.4; 15/172; 15/176.1; 15/145

[58] Field of Search ..... 114/222, 218; 15/105, 15/142, 144 B, 143 R, 172, 176.1, 176.4, 176.5, 159 A, 145, 144.4, 143.1

[56] References Cited

U.S. PATENT DOCUMENTS

| | | | |
|---|---|---|---|
| 630,261 | 8/1899 | McLane . | |
| 1,345,198 | 6/1920 | Kuck | 15/172 |
| 2,624,061 | 1/1953 | Leas | 15/144 B |
| 2,720,858 | 10/1955 | Siefken | 114/122 |
| 2,795,807 | 6/1957 | Salvy | 15/176.1 |
| 3,010,420 | 11/1961 | Glynn | 114/222 |
| 3,066,346 | 12/1962 | Hofstra et al. | 15/145 |
| 4,060,047 | 11/1977 | Sabella | 114/222 |
| 4,358,281 | 11/1982 | Woodward | 114/218 X |
| 4,407,213 | 10/1983 | Evans | 114/222 |
| 4,575,894 | 3/1986 | Stevens et al. | 15/176.5 X |
| 4,648,344 | 3/1987 | Burgers | 114/222 |
| 4,733,427 | 3/1988 | Conrad | 15/160 |
| 4,781,139 | 11/1988 | Burgers | 114/222 |
| 4,909,173 | 3/1990 | Strong | 114/222 |

FOREIGN PATENT DOCUMENTS

| | | | |
|---|---|---|---|
| 2757046 | 7/1979 | Fed. Rep. of Germany | 15/159 A |
| 2465568 | 4/1981 | France | 114/222 |

*Primary Examiner*—Sherman Basinger
*Attorney, Agent, or Firm*—Schapp and Hatch

[57] ABSTRACT

A flotation scrubber for cleaning boat bottoms while in the water having a cylindrical tubular head floatable in the water surrounded by removable and replaceable scrubbing material and operated by an elongated tubular handle providing a reinforced substantially right-angle bend near one end of the handle, the other end of the handle having telescoping sections for adjusting overall length. In one form of the invention, the scrubbing material is in the form of a removable sleeve sitting tightly over the cylindrical tubular head and having outwardly projecting bristles and/or fibrous plastic scrubbing material. In another form of the invention, the tubular head may be turned selectively to either a position perpendicular to the handle or a position parallel to the handle.

2 Claims, 2 Drawing Sheets

BOAT BOTTOM FLOTATION SCRUBBER

This application is a continuation-in-part of our pending application, Ser. No. 07/568,401, filed Aug. 16, 1990 and now U.S. Pat. No. 5,105,752.

BACKGROUND OF THE INVENTION

1. Field of the Invention.

This invention relates to devices for cleaning the bottoms of boats while the boats are in the water, and more particularly to such cleaning devices having a buoyant flotation scrubbing head tending to rise in the water against the bottom of the boat.

2. Description of the Prior Art.

Numerous efforts have been made to devise a boat bottom scrubber manipulatable from an adjacent dock or the like and in which the scrubbing apparatus is buoyant so it will float up against the bottom of the boat and facilitate the cleaning action. Typical of such devices are the implements disclosed in U.S. Pat. No. 3,010,420 issued Nov. 28, 1961 to James C. Glynn, which shows a rectangular block of buoyant material having a brush fastened to it and designed for manipulation by a handle having a joint in the middle intended to be held in desired position by a thumbscrew; U.S. Pat. No. 4,407,213, issued Oct. 4, 1983 to Peter R. Evans, which discloses a hollow cleaning head with a filler aperture enabling water to be introduced into the head to vary the buoyancy thereof, the cleaning head being mounted on a handle having a hinge intended to be held at a desired angle by a thumbscrew; and U.S. Pat. No. 2,720,858, issued Oct. 18, 1955 to Stuart B. Siefken, which shows a cylindrical tank mounted on the end of a straight handle and having a brush attached to the side of the tank.

Hinged handles such as those shown in the Glynn and Evans Patents are not capable of holding two sections of handle at a desired angle under the extreme conditions encountered while scrubbing plants and slime from the bottoms of boats.

A somewhat different approach to the problem of controlling the scrubbing head is illustrated in U.S. Pat. No. 4,060,047 issued Nov. 29, 1977 to Barney Sabella, this device also having thumbscrews to hold sections of a handle at a desired angle to each other, and having a bristle brush and a scraping head intended to be aligned with the bottom of the boat by elongated stabilizing members which contact the boat.

Another approach to a floatation scrubber is found in U.S. Pat. No. 4,648,344 issued Mar. 10, 1987 to John Burgers et al., and U.S. Pat. No. 4,781,139 issued Nov. 1, 1988 to John Burgers. Both of these patents show an elongated flexible strip which is buoyant and which carries a sheet of scrubbing material on its upper side for contact with the boat The flexible, buoyant strip is manipulated by a straight handle.

U.S. Pat. No. 4,909,173 issued Mar. 20, 1990 to Dwight J. Strong shows a scrubbing device in which the scrubbing head does not depend on buoyancy to urge it against the bottom of the boat, this being accomplished by a vane on the scrubbing head inclined in such manner as to force the scrubbing head against the bottom of the boat as it is moved therealong.

U.S. Pat. No. 4,733,427 issued Mar. 29, 1988 to Richard H. Conrad, shows a swimming pool brush having an inclined vane for urging it against the bottom and sides of the swimming pool, while U.S. Pat. No. 630,261 issued Aug. 1, 1899 to George A. McLane shows a barnacle scraper mounted on a straight pole and having a brush along its triangular edge.

The above-listed patents are believed to be relevant to the present invention because they were adduced by a prior art search made by an independent searcher, and a copy of each of the above-listed patents is supplied to the Patent and Trademark Office herewith.

Summary of the Invention

The floatation scrubber of the present invention, for cleaning boat bottoms while in the water, provides a cylindrical tubular head floatable in the water to rise against the bottom of a boat to be cleaned, scrubbing material replaceably mountable in covering relation on the cylindrical tubular head and an elongated tubular handle having a cleaning end connected to the middle of the cylindrical tubular head, the elongated tubular handle having an integral, rigid right-angle bend adjacent to the cleaning end whereby a person standing on the dock alongside the boat can scrub the cylindrical tubular head against the bottom of the boat and remove unwanted growth therefrom.

In order to facilitate use of the present device on different sizes of boats by persons standing on docks, floats or boats of varying heights from the water, the elongated tubular handle is provided in a plurality of telescoping sections formed for extending and contracting the overall length of the handle to adapt the present floatation scrubber to the varying conditions encountered.

In one form of the invention, the scrubbing material is on a sleeve which is formed with a suitable scrubbing surface such as radially outwardly projecting stiff brush bristles, or a mat of intertwined stiffly flexible plastic fibers strong enough and abrasive enough to produce the desired scrubbing action.

It has been found that alternating bands of the radially outwardly projecting stiff brush bristles and the intertwined stiffy flexible plastic fibers considerable facilitate the cleaning of the various kinds of bottom-fouling materials encountered.

In another form of the invention, the scrubbing means is provided by a plurality of stiff brushes removably mountable in covering relation on the cylindrical tubular head. The exterior of the cylindrical tubular head is integrally formed with a plurality of parallel circumferentially spaced mounting slots, and the strip brushes have backing members extending along the length of the mounting slots, with the backing members being slidably mountable in the mounting slots with the bristles of the strip brushes extending radially outwardly from the cylindrical tubular head.

The connection of the cleaning end of the handle to the cylindrical tubular head is provided by a mounting head secured to the cleaning end of the handle and having bosses slidably engageable in the mounting slots for releasably securing the handle to the cylindrical tubular head. As a feature of this form of the invention, the mounting head is pivotably mounted on the handle for swinging movement of the cylindrical tubular head between a first position perpendicular to the cleaning end of the handle and a second position parallel to the cleaning end of the handle, means being provided for selectively holding the mounting head in the first and second positions.

The integral and rigid substantially right-angle bend in the handle near the scrubbing head makes it possible for a person standing on a dock or other structure near the boat being cleaned to reach the scrubbing head all the way under the boat to the keel. At the same time, the integral and rigid construction is such that the bend does not weaken the handle nor come unbent. Preferably, the right-angle bend is reinforced with a gore plate to insure rigidity.

The end of the handle is securely attached to the cylindrical tubular head to improve control and avoid breakage at the juncture. The sleeve carrying the scrubbing material is split lengthwise and is resilient so it can be slid off the head and replaced as desired. Detent means is provided for releasably holding the sleeve against endwise movement on the head.

It is therefore a principal object of the present invention to provide a floatation scrubber capable of manipulation by a person standing near the boat while the boat is in the water.

Another object of the present invention is to provide a floatation scrubber of the character described in which the handle is formed to facilitate cleaning of the entire bottom of the boat from all positions.

A further object of the present invention is to provide a floatation scrubber of the character described in which the scrubbing material is readily removable and replaceable on the cylindrical head, and is held securely against removal while in operation.

Other objects and features of advantage will become apparent as the specification proceeds and from the claims.

Figure 1:
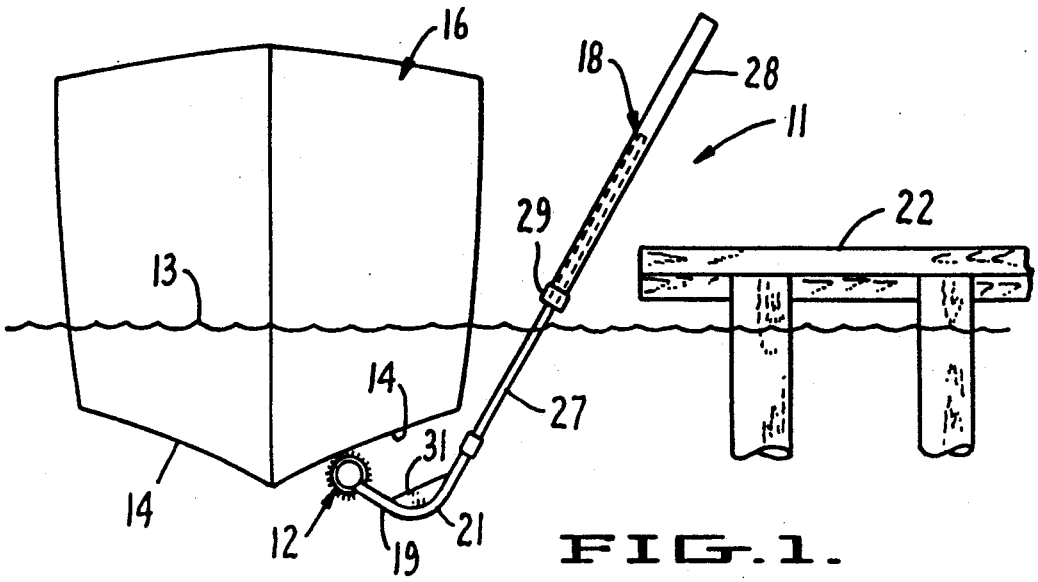
FIG. 1 is a front elevational view of a boat adjacent to a dock and having the floatation scrubber of the present invention in operative position for cleaning the bottom of the boat.
Figure 2:
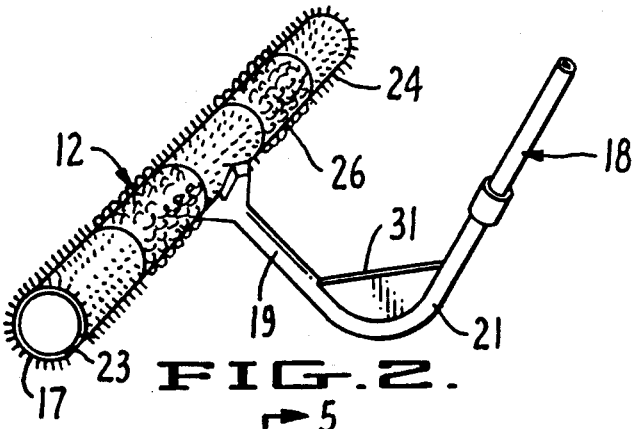
FIG. 2 is a perspective view on an enlarged scale of the scrubbing head and adjacent handle forming part of the apparatus of FIG. 1.
Figure 3:
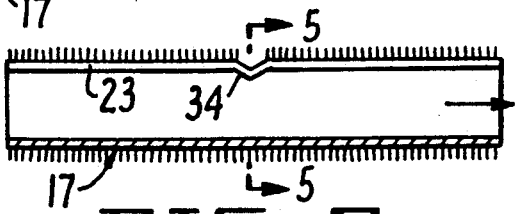
FIG. 3 is a longitudinal cross-sectional view of a scrubbing material sleeve forming part of the device of FIG. 2.
Figure 4:
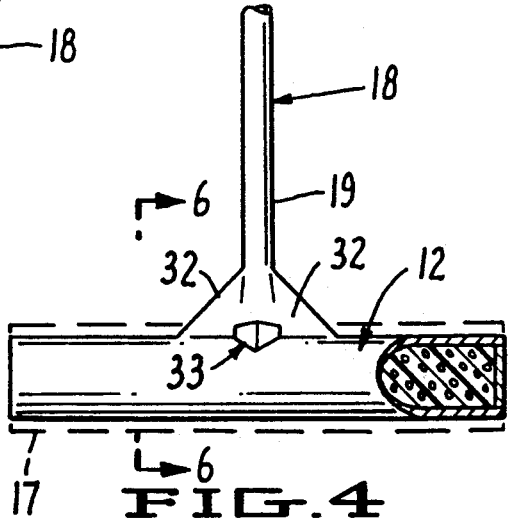
FIG. 4 is a side elevational view of a scrubbing head and attached handle ready for receiving the sleeve of FIG. 3, with a portion of the view being broken away and shown in section to reveal internal construction.

While only the preferred forms of the invention are illustrated in the drawings, it will be apparent that various modifications could be made without departing from the ambit of the claims.

DESCRIPTION OF THE PREFERRED EMBODIMENTS

The floatation scrubber 11 of the present invention provides a cylindrical tubular head 12 which is buoyantly floatable in the water 13 to rise against the bottom 14 of a boat 16 to be cleaned. Scrubbing means 15 is replaceably mountable in covering relation on the cylindrical tubular head 12. An elongated tubular handle 18 has a cleaning end 19 connected to the middle of the cylindrical tubular head 12. The elongated tubular handle 18 has an integral, rigid substantially right angle bend 21 adjacent to the cleaning end 19 whereby a person (not shown) standing on a dock 22 alongside the boat 16 can scrub the cylindrical tubular head 12 against the bottom 14 of the boat 16 and remove unwanted growth therefrom. The device can be fabricated of metal or molded of high strength plastic.

In the form of the invention illustrated in FIGS. 1 through 6 of the drawings the scrubbing means 17 is provided by a sleeve 17 of cylindrical form having an open slot 23 running along its length. The sleeve 17 is formed with a suitable scrubbing surface such as outwardly projecting stiff brush bristles 24, or a mat 26 of intertwined stiffly flexible plastic fibers strong enough and abrasive enough to produce the desired scrubbing action. The particular scrubbing material 24 or 26 which is most effective for removing the fouling on the bottom of the boat being cleaned may be chosen for the particular application. The entire removable sleeve 17 may be covered with the same material, or, in the manner shown in FIG. 2 of the drawings, the materials 24 and 26 may be in the form of alternating bands for increased effectiveness.

In accordance with the present invention, the elongated tubular handle 18 has a pair of telescoping sections 27 and 28 for extending or contracting the overall length of the handle 18 to adapt the floatation scrubber 11 to different heights of docks 22 and depth of the boat bottom 14 being cleaned. A connector member 29 selectively locks the sections 27 and 28 together at the desired adjustment.

As an important feature of the present invention, the floatation scrubber 11 is light in weight, but sturdy and solid enough not to be bent, broken or otherwise misadjusted during extreme conditions of use. For this purpose, the right angled end 21 is reinforced with a gore plate 31 molded, welded or brazed across the throat of bend 21.

Also for the purpose of strength, in the embodiment of FIGS. 1 through 6, the end 19 of handle 18 is rigidly and permanently attached to the tubular head 12, reinforcing gore plates 32 being provided to improve control and avoid breakage at the juncture of handle end 19 with tubular head 12.

Figure 5:
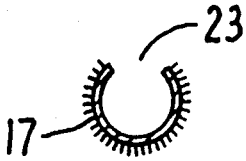
FIG. 5 is a vertical cross-sectional view taken substantially don the plane of Line 5—5 of FIG. 3.
Figure 6:
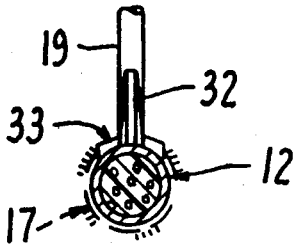
FIG. 6 is a vertical cross-sectional view taken substantially on the plane of Line 6—6 of FIG. 4.

As may best be seen in FIGS. 5 and 6 of the drawings, the longitudinal slots 23 through sleeve 15 splits the sleeve lengthwise. The sleeve is made of a stiffly resilient material contoured to be slidably received on the tubular head 12. Detent means 33, for releasably holding the sleeve 17 against endwise movement on the head 12, projects laterally from handle end 19 and is engageable in notches 34.

Figure 7:
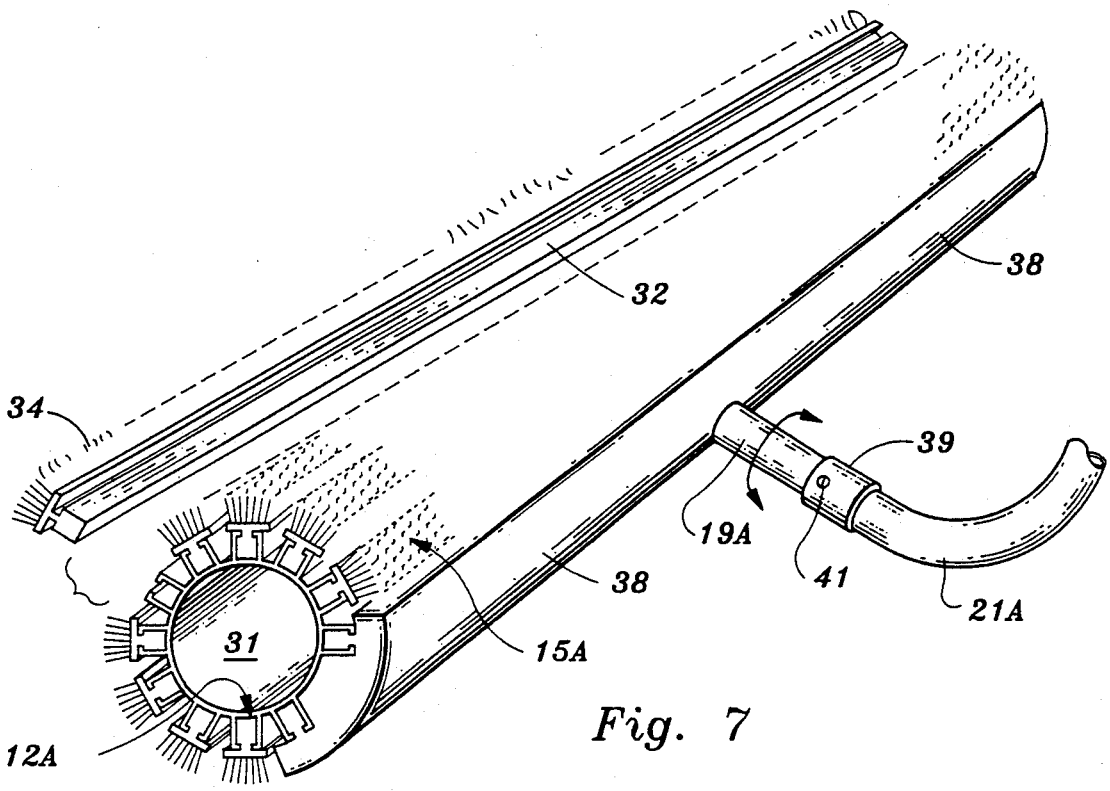
FIG. 7 is a perspective view similar to that of FIG. 2, but illustrating a modified form of the invention.
Figure 8:
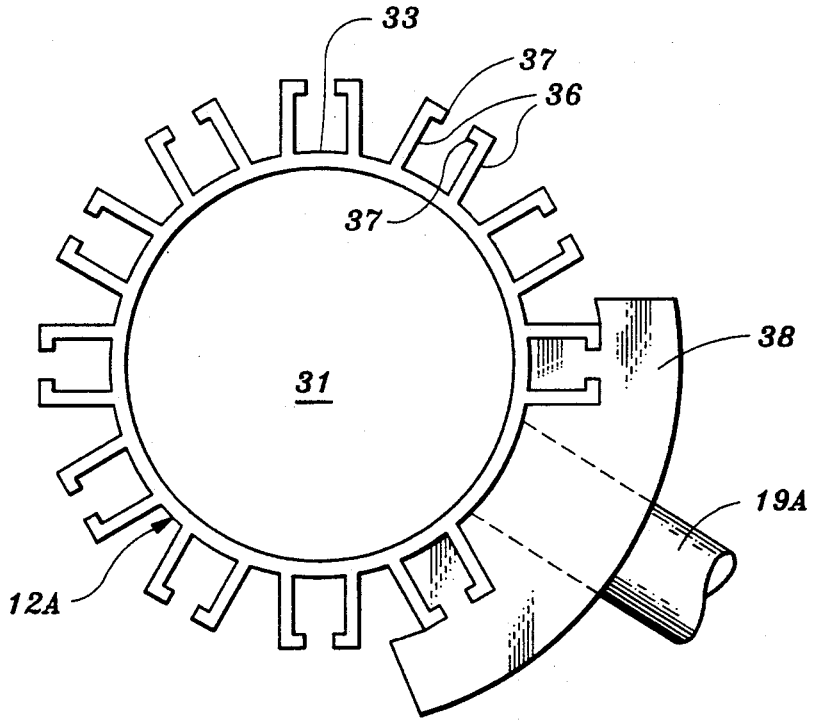
FIG. 8 is a side elevational view of a cylindrical head and mounting head forming part of the device of FIG. 7.

In the form of the invention illustrated in FIGS. 7 and 8 of the drawings, a plurality of strip brushes extends longitudinally of the head 12A over substantially its entire surface.

The head 12A is provided with ends 31 to provide a hollow, buoyant, cylindrical chamber. As may best be seen in FIG. 7 of the drawings, the scrubbing means is provided by a plurality of strip brushes having an elongated rigid backing member 32 adapted for sliding engagement in longitudinal parallel slots 33 provided on the exterior of the cylindrical heads 12A. Bristles 34 are mounted in the strips 32 to project radially outwardly when the strips 32 are engaged in the slots 33. As wear occurs, the strip brushes 34 may be slid longitudinally out of their slots 33 for replacement.

Preferably, the head 12A is made of a strong plastic material having radially outwardly extending strips 36 having inturned flanges 37 running along the tops of the strips 36.

Preferably, and as shown in FIG. 8 of the drawings, the handle 19A is securely mounted to the head 12A. For this purpose, the handle 19A is securely attached to a mounting head 38 having portions engageable in the slots 33. The proportions and materials are such that the mounting head 38 remains securely in place on heads 12A during all conditions of use.

As a feature of the form of the invention illustrated in FIG. 7 of the drawings, the scrubbing head 12A is mounted on a swivel means 39 secured to the handle 21A and rotatably supporting handle 19A. A set screw 41 in coupling 39 permits the handle 21A to be rotated between a first position, see FIG. 7, in which the scrubbing head 12A is perpendicular to the plane of the handle 21A.

Certain types of scrubbing operations make it desirable to position the scrubbing head 12A at other positions relative to the handle 21A such as with the head 12A extending parallel to the handle 21A.

From the foregoing, it will be apparent that the floatation scrubber of the present invention is capable of effecting thorough cleaning of boat bottoms while in the water, with the operator standing on a dock, float or another boat. The present device is light in weight, easily manipulatable, strong and not prone to break or bend, and selected scrubbing materials may be used and replaced easily and quickly on the scrubber head.

What is claimed is:

1. A floatation scrubber for cleaning boat bottoms while in the water, comprising:

a cylindrical tubular head floatable in the water to rise against the bottom of a boat to be cleaned;

scrubbing material replacably mountable in partially covering relation on said cylindrical tubular head; and an elongated tubular handle providing a cleaning end having a connection to the middle of said cylindrical tubular head;

said elongated tubular handle being formed with an integral rigid substantially right-angle bend adjacent to said cleaning end whereby a person standing on a dock alongside said boat can rub said scrubbing material on said cylindrical tubular head against the bottom of said boat and remove unwanted growth therefrom;

said scrubbing material being in the form of a plurality of strip brushes removably mountable in covering relation on said cylindrical tubular head;

the exterior of said cylindrical tubular head being integrally formed with a plurality of parallel circumferentially spaced mounting slots and said strip brushes having backing members extending along the length of said mounting slots and being slidably mountable in said mounting slots; and said connection of said cleaning end of said handle to said cylindrical tubular head comprising a mounting head secured to said cleaning end of said handle and having bosses slidably engagable in said mounting slots for releasably securing said handle to said cylindrical tubular head.

2. A floatation scrubber as claimed in claim 1 wherein said mounting head is pivotably mounted on said handle for swinging movement of said cylindrical tubular head between a first position perpendicular to said cleaning end of said handle and a second position parallel to said cleaning end of said handle and means is provided for selectively holding said mounting head in said first and second positions.

* * * * *